US008336537B1

(12) United States Patent
Peters, Jr.

(10) Patent No.: US 8,336,537 B1
(45) Date of Patent: Dec. 25, 2012

(54) SAWDUST/PELLETS/WASTE STOVE OR DRYER

(75) Inventor: John Milton Peters, Jr., Fairbanks, AK (US)

(73) Assignee: John M. Peters, Jr., Fairbanks, AK (US)

( * ) Notice: Subject to any disclaimer, the term of this patent is extended or adjusted under 35 U.S.C. 154(b) by 1297 days.

(21) Appl. No.: 12/080,833

(22) Filed: Apr. 7, 2008

(51) Int. Cl.
*F24B 5/04* (2006.01)
*F24C 15/00* (2006.01)

(52) U.S. Cl. ..... 126/225; 126/67; 126/77; 126/222; 126/9 R; 110/165 R; 110/204; 110/205; 110/346; 431/328

(58) Field of Classification Search ..... 126/225, 126/67, 77, 222, 9 R; 110/165 R, 204, 205, 110/235, 251, 346; 431/328
See application file for complete search history.

(56) References Cited

U.S. PATENT DOCUMENTS 1,391,415 A * 9/1921 Schonitzer ..... 126/9 R
1,508,334 A * 9/1924 Ingalls ..... 126/43
1,705,403 A * 3/1929 hazlewood ..... 126/225
2,555,779 A * 6/1951 Boone ..... 126/222
4,201,186 A * 5/1980 Paquin ..... 126/83
4,502,464 A * 3/1985 Figueroa ..... 126/163 R
4,607,610 A * 8/1986 Zimmermann ..... 126/76
4,747,781 A * 5/1988 Patenaude ..... 431/326
6,067,979 A * 5/2000 Jaasma et al. ..... 126/77
2004/0129262 A1* 7/2004 Pieti ..... 126/146
2008/0276924 A1* 11/2008 McMillan ..... 126/77

* cited by examiner

*Primary Examiner* — Steven B McAllister
*Assistant Examiner* — Nikhil Mashruwala

(57) ABSTRACT

A center burn technology for a stove or dryer for the burning of solid, loose or compressed fuels, or mixtures of fuels. The stove uses a center burn draft and combustion through the combustion material. The preferred embodiment of this stove consists of at least two bins, an outer exhaust bin and inner combustion bin. A vertically placed air core combustion tube is resting within a stabilizing support collar at the top and at the bottom the tube rests inside of a tapered apparatus. The smaller opening at the bottom of the tapered apparatus provides return gas venting and easy ash drop system to ash bin or pan below. Exhaust drafts through vents between said bins at the upper portion of the inner combustion bin. The stove provides a long efficient burn with a steady combustion temperature. The stove does not require the use of electricity.

1 Claim, 5 Drawing Sheets

SAWDUST/PELLETS/WASTE STOVE OR DRYER

BACKGROUND OF THE INVENTION

This present invention relates to the art of the combustion of solid fuels. Solid fuel burners have been used to dispose of waste products such as garbage, sawdust, pellets, coal, and the like. Prior art requires the constant feeding of either mechanical means or on a slide slope to the combustion area in order to keep a flame. Some burners drop fuel into the burner using an air drafted into a rotating cyclone-forced air furnace. Some stoves are designed to feed fuel with augers or other mechanical means and some use a combustion bed which also must be fed.

This stove can be utilized to heat homes, shops, greenhouses, tents and even a very small version can be used for backpackers and emergency use. It requires no electricity and can burn materials efficiently. The design of this present invention insulates the burn with the fuel materials, causing it to burn much hotter and cleaner. Many stoves require additional electric fans to make them burn clean, while this stove burns clean without such additions. This stove can efficiently burn biomass such as forest debris, waste from manufacturing, and wood chips. It doesn't require the cutting down of large trees. Fuel can be made from undergrowth/brush that can be chipped or processed pellets can be used which are made of waste products. Chipped and pelleted material dry faster that large bulky logs. This takes more energy to burn solid or wet logs. It takes many years to produce large trees for the conventional wood stove. This present stove provides heat from waste products without requiring deforestation. The conventional wood stoves are less efficient and require a large amount of trees to be cut. This in turn cuts down the amount of oxygen in the atmosphere. A lot of countries and areas do not have trees to cut and need an efficient stove which burns clean and can utilize whatever materials are available. Many parts of the world do not have electricity. Backpackers can also utilize this stove because they can carry sawdust or pellets in small amounts, mix in small quantities of forest floor materials and have a stove that burns for a long time on a small amount of fuel. This stove burns safely inside an inner combustion bin with a consistent heat without much fluctuation. While other stoves can cause forest fires or burning of tents by the hot embers and sparks. This present invention doesn't allow sparks or burning embers to be released. Emergency response teams could use this stove during weather emergencies such as floods, volcanoes, hurricanes, earthquakes, etc. when electrical power outages are common. Because these events are happening more frequently, an emergency stove is needed that can provide heat to warm food and for shelter. A smaller version of this stove could also be manufactured in large quantities for such relief. This stove is also a good dependable heat source for a greenhouse because of the long burning heat without electricity and fluctuating heat.

Pellet stoves generally require utilization of an electric blower and drive motors while burning pellets which increases the chances of failure in the stove when electricity is shut off. Some times there is smoke damage and the stove can jam full of pellets if there is a power or mechanical failure. There is always a possibility of failure of the electrical components and these parts must be maintained. The auger feed pellet stove requires clean fuel. Sometimes dust and debris causes the auger to clog up. The auger is only made for certain sized material. Some fuels cause the auger to clinker up, making the stove inoperable. The use of mechanical means increases the cost of manufacture of the stove and also the heating costs.

The closest prior art related to this present invention is the Fulgor stove, commercially produced in Battersea, London (patent 595869 expired). The Fulgor stove is designed to burn sawdust and wood shavings. The Fulgor stove requires the user to manually place a stick or tubing inside the removable bin while loading the sawdust and packing it with another instrument. When the stick or tube is carefully removed it leaves an air way opening for the combustion and draft. The fuel is ignited from the bottom of the stove. This prior art produces a center burn in the bin placed inside the stove. In an article about the Fulgor stove it states that "shavings or chippings will work provided they don't collapse down the airway". In this prior art, there is no way of preventing a collapse of the fuel. Even sawdust and shavings can collapse into the air way in the Fulgar stove. Center burn technology has not improved. Another requirement of the Fulgor stove is removal of the bin after each burn and filling with fuel before putting it in the stove. This requires lifting it in and out of the outer bin of the stove. The Fulgor stove only burns for 4 to 8 hours because the volume is limited by the amount a person can lift into the stove. In an article in Mother Earth News there is an article about a related a center-burn tin can stove. The article stated that someone should manufacture a sawdust fuel mixed with wax or other bonding agent to hold its shape so that it could be dropped into a stove. This present invention solves these aforementioned problems in prior art and expands the technology to include other loose fuel sources. In common combustion stoves, loose fuel products such as sawdust and shavings tend to smolder and do not get adequate oxygen unless supplied by forced draft such as a fan which causes the sawdust to burn rapidly preventing a long burn time. Sawdust and wood shavings are loose cellular material and are hard to handle and considered messy. For these reasons, the center burn technology has not advanced. This present invention is able to advance the center burn technology. This present invention can burn the newer fuel sources such as pellets or compressed fuels allowing even a longer burn than non-compressed fuels. This present invention provides an air way and draft means by using an air core tube which keeps the fuel from collapsing down the air way. This allows the user many fuel choices and is a better technology. It does not require the lifting of a loaded bin. In this present invention, no stick or tube is used to provide for an airway and does not require removal of said stick or tube after loading the fuel into the inner combustion bin. The solid fuel burners have not utilized this present technology which enables combustion material to burn hotter and longer from the middle outward. This present invention uses a tapered funnel with neck which allows the ash to drop down into an ash bin or pan below after it is burned and does not require constant feeding of the combustion materials as in other stoves. In this preferred embodiment, an inner combustion and an outer exhaust bin is used for reburning of the gases enabling a cleaner burn. When using this center burn technology, the fuel is a natural insulator and burns longer and hotter, enabling a more complete combustion. This invention is a very efficient design for the burning of fuel without other mechanical means.

SUMMARY OF THE INVENTION

This present invention uses center burn technology, a unique method for removing ash and venting gases. This center burn stove can be used for heating, cooking, water heater, outdoor purposes such as camping, dryers, greenhouses, animal facilities, emergency response, prevention of crop loss from frost, etc. It can be used inside for heating of homes, workshops, manufacturing facilities, barns, etc. Embodiments and size of stove can vary greatly while using the same technology. Embodiments could even include more than one air core tube and tapered funnel with neck within the said stove.

This present invention is a simple design not previously invented. It will work effectively with or without electricity. It can be adjusted to burn very slowly with its own center burn combustion with an air core tube (FIGS. 5., 6., and 7., Reference 15) that prevents the sawdust/pellets/wood products from collapsing and clogging the airway. This stove uses a unique exhaust venting system which has exhaust vent openings near the top of the inner combustion bin (FIG. 6, Reference 20.) FIG. 5. shows arrows between the outer exhaust bin and the inner combustion bin. These arrows depict the flow of exhaust from the exhaust vent openings near the top of the inner combustion bin (FIG. 6., Reference 20) down to be drawn up through the return exhaust openings in the neck of the tapered funnel (FIGS. 5., and 6., Reference 19.) This embodiment is an improvement over prior art as it uses an inner combustion bin cover (FIGS., 2., 5., and 6., Reference 6) that allows the exhaust to circulate and keep the stove hotter within the inner combustion bin (FIGS. 5., 6., 7., and 8., Reference 2.) before the exhaust exits the said inner combustion bin.

This embodiment of the sawdust/pellet/waste stove or dryer consists of an outer exhaust bin (FIGS. 1., and 5., Reference 1.) and inner combustion bin (FIGS. 5., 6., 7., and 8., Reference 2.)

In this embodiment, a tapered material loading tool (FIG. 4, Reference 11) is placed above the stove which prevents spilling of sawdust/pellets/waste. Materials can also be loaded during the burn cycle. The burn materials can be loaded directly into the inner combustion bin not requiring removal of the inner combustion bin for loading.

A vertically placed air core tube with many apertures (FIGS. 5., 6. and 7., Reference 15.) prevents unburned materials from falling or collapsing and choking the air way and provides a draft means. This preferred embodiment, has one end of the stabilizer straps (FIGS. 5., 6., and 7., Reference 16.) attached to a air core tube stabilizer support collar (FIGS. 5., 6., and 7., Reference 21) allowing unrestricted vertical movement through a gap (FIG. 7., Reference 22.) allows the air core tube (FIGS. 5., 6., and 7., Reference 15.) to be moved up and down freely. The other end of the stabilizer straps for the air core tube (FIGS. 5, 6, and 7, Reference 16.) are held in place by attaching them to the to the inner combustion bin (FIGS. 5., 6. and 7., Reference 2.) In this preferred embodiment, this air core tube support collar (FIGS. 5., 6., and 7., Reference 21.) keeps the air core, tube (FIGS. 5., 6., and 7., Reference 15) in place at the top and the tapered funnel with neck (FIGS. 5. and 6., Reference 18.) keeps it aligned at the bottom. The air core tube (FIGS. 5., 6., and 7., Reference 15.) is made to be pulled up to allow for removal of ash buildup after the burn cycle. There is a gap (FIG. 7., Reference 22.) between the air core tube (FIGS. 5., 6., and 7., Reference 15.) and the stabilizer support collar for air core tube (FIGS. 5., 6., and 7., Reference 21.) removal and sliding the air core tube (FIGS. 5., 6., and 7., Reference 15.) up and down. In this preferred embodiment, a removable cap for the air core tube (FIGS. 5. and 6., Reference 17), is placed on top of the air core tube (FIGS. 5., 6., and 7., Reference 15.) to prevent materials from falling down the air way through the air core tube (FIGS. 5., and 6., Reference 15.) while loading the materials into the inner combustion bin (FIGS. 5., and 6., Reference 2.) In this preferred embodiment, the removable cap for the air core tube (FIGS. 5., and 6., Reference 17.) is placed on the air core tube (FIGS. 5., and 6., Reference 15.) and then removed after loading the stove.

In this stove the preferred method is to ignite the stove is from the bottom of the air core tube (FIGS. 5, and 6 Reference 15.) where the said tube rests on the neck of the tapered funnel (FIGS. 5. and 6., Reference 18.) Those persons experienced in the art of stove building realize that there are a variety of ways the stove can be ignited from above such as with a fire starter or other means dropped down the air core tube (FIGS. 5., and 6., Reference 15.) with suspension means such as an aperture attachment in the air core tube (FIGS. 5., and 6., Reference 15) or with an electrical igniter. The air core tube (FIGS. 5., and 6., Reference 15.) in this present invention prevents larger wood scraps from falling in the airway, allowing the operator to burn many different sizes and type of materials in the inner combustion bin (FIGS. 5., and 6., Reference 2.)

In this embodiment, a tapered funnel with neck (FIGS. 5 and 6, Reference 18.) extending through a hole or opening (FIGS. 1. and 6., Reference 9) in the bottom of outer exhaust bin (FIGS. 1., 5., Reference 1.) and the bottom of the inner combustion bin (FIG. 6., Reference 2.) allow any residue and ash to slide down into the ash bin or pan (FIGS. 1 and 5, Reference 4.) There are return exhaust openings in the neck of the funnel (FIGS. 5 and 6, Reference 19.) for cooler gases in the outer exhaust bin (shown by arrows on FIG. 5) which are drawn into the neck of the funnel (FIGS. 5., and 6., Reference 18.) by fresh combustion air going up through the air core tube (FIGS. 5., 6., and 7., Reference 15.) These return gases are rebumed in the air core tube (FIGS. 5., and 6., Reference 15.) and draft through the exit exhaust and stack (FIG. 1, Reference 3.) In this embodiment, the tapered funnel with neck (FIGS. 5. and 6., Reference 18.) lines up the outer exhaust bin (FIG. 1, Reference 1.) and the inner combustion bin (FIGS. 5., and 6., Reference 2.) so the bins do not have to be fastened together which allows for easy cleaning, removal and inspection purposes. This simple design allows the weight of the air core tube (FIGS. 5., and 6., Reference 15.) to align itself centrally while resting in opening of the neck of the tapered funnel (FIGS. 5. and 6., Reference 18.)

FIGS. 2., 5., 6., and 8., Reference 6. shows the inner combustion bin cover with lifting handle (Reference 8.) and FIGS. 3., 5., Reference 7 shows the outer exhaust bin cover and lifting handles (Reference 8.)

In this preferred embodiment, the inner combustion bin cover (FIG. 8. and Reference 6.) has an insulation cavity (FIG. 8., Reference 6*a*.) for optional insulation between a tapered-shaped cover (FIG. 8, Reference 6*b*) which is attached below inner combustion bin cover (FIG. 8, Reference 6*b*.) directing the heat away from the center of the top of the stove and slows the exhaust in the inner combustion bin so the gases remain longer in the combustion area and produces the hottest burn throughout the stove. It also radiates the heat more evenly. Related inventions do not use this exhaust system but leave the top open and do not have a means to slow the exhaust flow before leaving the inner combustion bin (FIG. 5., Reference 2.)

In this embodiment, FIGS. 1 and 5 show a typical arrangement for an ash bin or pan (Reference 4.). FIG. 5 shows door to the ash bin or pan (Reference 10.), hinges to the ash bin door (Reference 13.), latch to the ash bin door (Reference 14.), draft control (Reference 12.) and the stove support legs (Reference 5.). There are many varieties of mechanical latches which could be used. High temperature seals should be used to seal the outer exhaust bin cover (FIGS. 3., and 5., Reference 7) which are not shown because those skilled in the art would know that these are needed. There are a variety of ways to implement ash removal, draft control means, and door design which are not shown. This stove could also be used with or without electrical draft controls and thermostats. The stove design shown was in a round design but the stove could be built in different sizes and shapes. There are a variety of locations and sizes an exhaust stack could be used on the stove.

While in the foregoing specification embodiments of the invention have been set forth in considerable detail for the purposes of making a complete disclosure of this invention, it will be apparent to those of the ordinary skill in the art that numerous changes may be made in such details without departing from the spirit and principles of the invention.

BRIEF DESCRIPTION OF DRAWINGS

Page 1/5

Page 2/5

Figure 3:
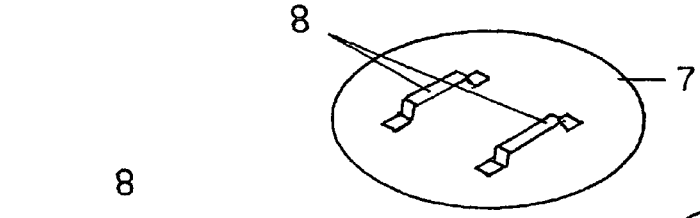
FIG. 3. Isometric Side View (looking from above) This figure shows the outer exhaust bin cover with lifting handles.
Figure 4:
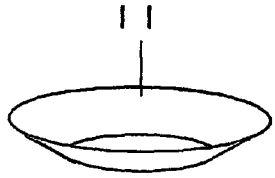
FIG. 4. Isometric Side View (looking from above) This figure shows a taperedmaterial loading tool.
Figure 2:
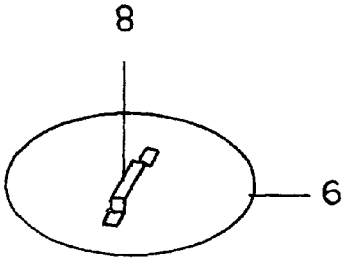
FIG. 2. Isometric Side View (looking from above) This figure shows the inner combustion bin cover with lifting handle.
Figure 1:
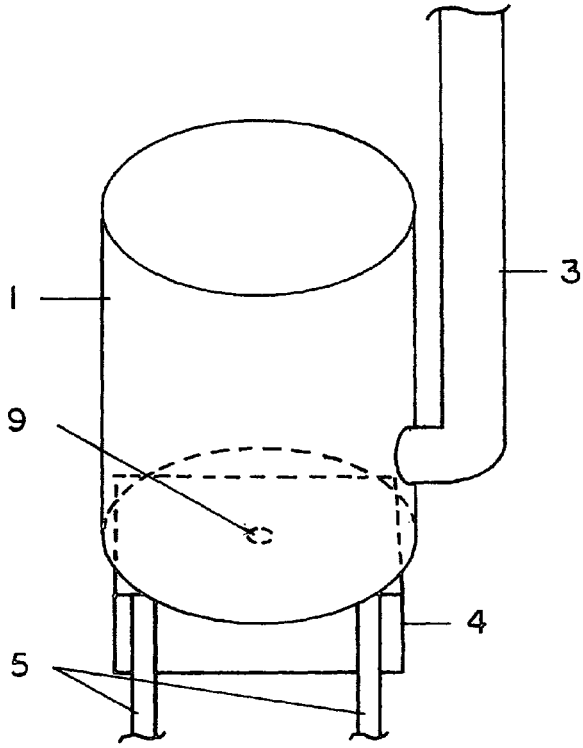
FIG. 1. Isometric Outer View (looking from above) This figure shows the side view of the coal/sawdust/pellet/waste stove with exhaust means.
Figure 5:
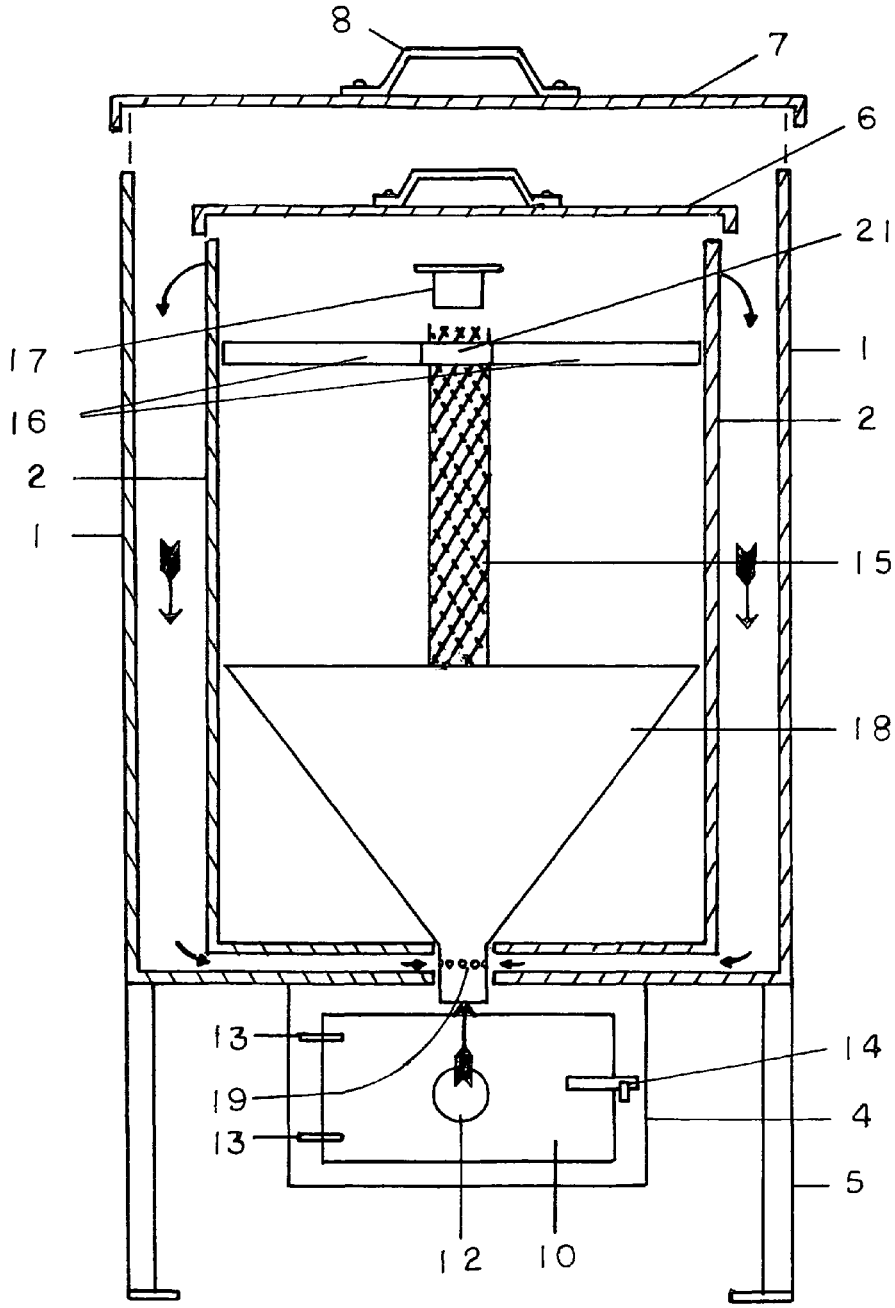

FIG. 5. Exploded Side View (looking from same level) This figure is a partial cut away view of outer exhaust bin and the inner combustion bin and the covers. Inside the cut away, it shows the arrangement of internal parts of this present invention of the improved sawdust/pellet/waste stove. The arrangement in this drawing shows a. arrows depicting return gas flow as they cool, b. removable cap for air core tube, c. stabilizer straps for the air core tube, d. air core tube stabilizer support collar, e. air core tube, placement of the tapered funnel with neck protruding through the bottom inner combustion bin and outer bin allowing ash to fall into an ash bin.

This cut away also shows the exhaust openings on the neck of the tapered funnel which allow return of gases into the combustion area and the bottom spacing between the bins shows the return draft of the gases. The lower portion of the drawing below the neck of the funnel (the funnel neck being inside of the ash bin), shows combustion air is drawn through an adjustable draft means below the combustion area on the door of the ash bin. The lower portion of the drawing is not cut away and shows a typical ash bin, draft control, door with hinges and latch, and support legs. This is a preferred embodiment.

Page 3/5

Figure 6:
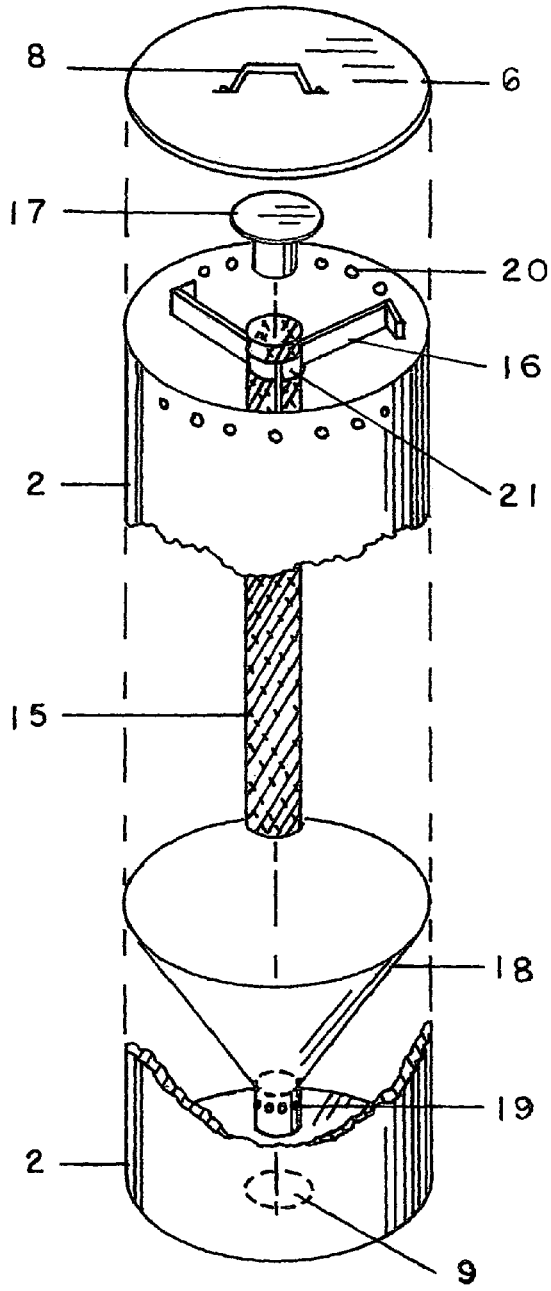

FIG. 6. Isometric Exploded Cut Away Side View (from above) This figure shows arrangement of the following parts: the inner combustion bin cover with lifting handle, removable cap for air core tube, stabilizer straps for the air core tube, air core tube stabilizer support collar, top cut away of the inner combustion bin, exhaust vent openings near the top of inner combustion bin, air core tube, tapered funnel with neck, return exhaust openings in the neck of the funnel, bottom cut away portion of the inner combustion bin, bottom of the bin's opening to insert the neck of the tapered funnel. This is a preferred embodiment.

Page 4/5

Figure 7:
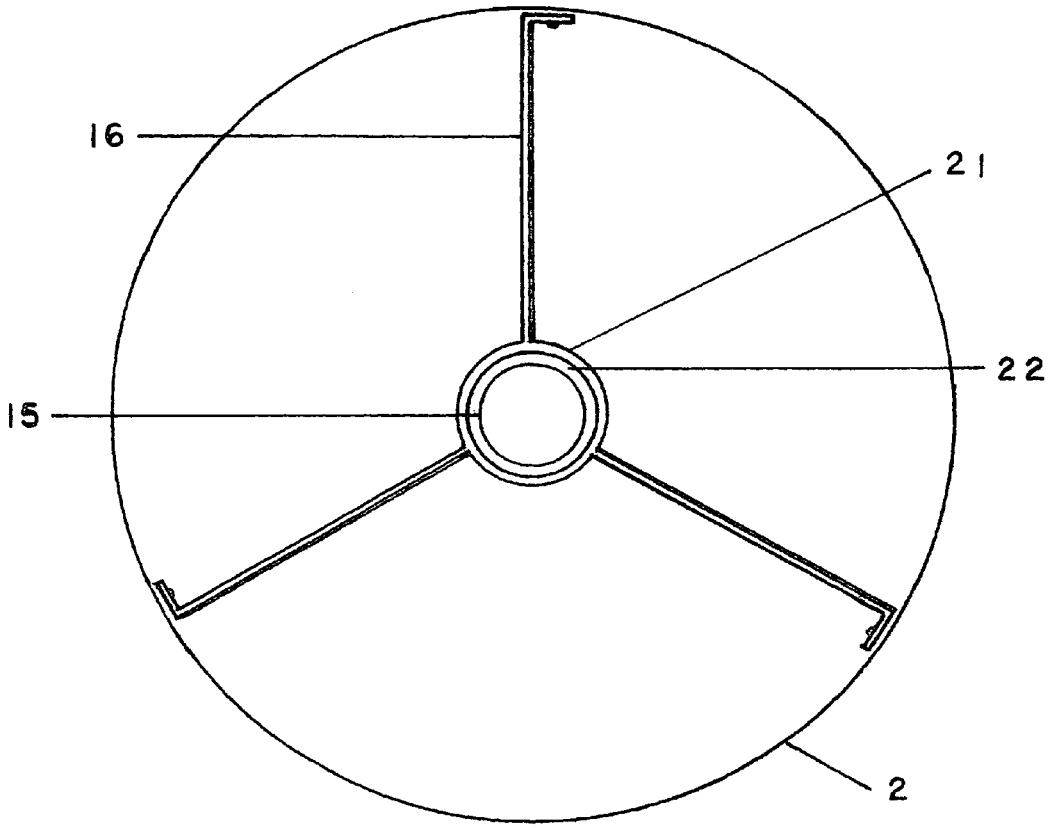

FIG. 7. Prospective View (looking straight down from above looking into the inner combustion bin) This figure shows placement of the stabilizer straps for the air core tube, air core tube stabilizer support collar and the air gap spacing between air core tube stabilizer support collar and air core tube. This is a preferred embodiment.

Page 5/5

Figure 8:
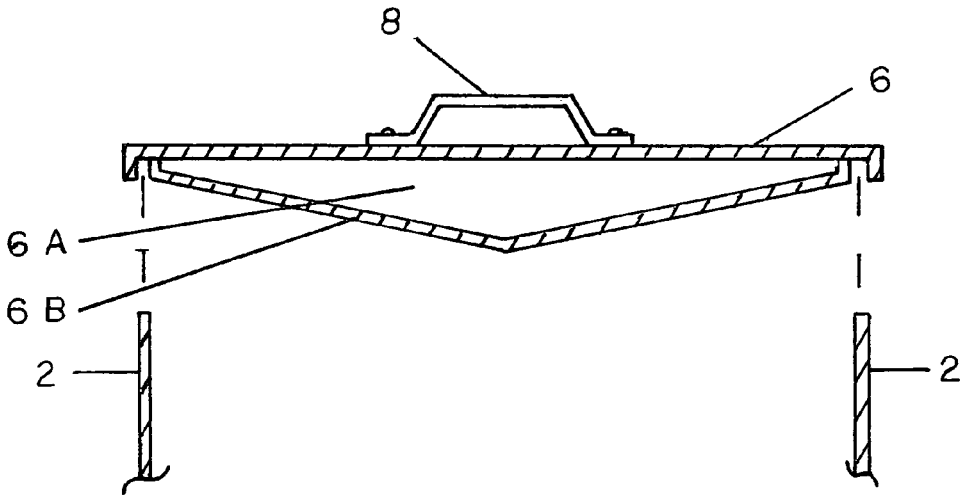

FIG. 8. Exploded Cut Away Side View of Inner Combustion Bin Cover with lifting handle and the top of the inner combustion bin shown below. This figure shows an insulation cavity below the cover and a tapered-shaped cover below to protect insulation in the cavity. This is a preferred embodiment.

A LIST OF FEATURED PARTS WITH REFERENCE NUMBERS

1. Outer exhaust bin
2. Inner combustion bin
3. Exhaust exit and stack
4. Ash bin or pan
5. Stove support legs
6. Outer exhaust bin cover
6*a*. Insulation cavity
6*b*. Tapered-shaped cover
7. Inner combustion bin cover
8. Lifting handles
9. Bottom of the bin's opening to insert the neck of the funnel
10. Door to the ash bin
11. Tapered material loading tool
12. Draft control
13. Hinges to the ash bin door
14. Latch to the ash bin door
15. Air core tube
16. Stabilizer straps for the air core tube
17. Removable cap for air core tube
18. Tapered funnel with neck
19. Return exhaust openings in the neck of the funnel
20. Exhaust vent openings near the top of inner combustion bin
21. Air core tube stabilizer support collar
22. Gap between stabilizer support collar and air core tube

What is claimed is:

1. A solid fuel burner assembly, comprising:

a) an inner combustion bin having a top wall, a cylindrical wall and a bottom wall, the inner combustion bin having a plurality of vent openings near its top, and having a bottom opening in the bottom wall;

b) a tapered fuel container located within the inner combustion bin to carry and combust solid fuel, the tapered fuel container having a cylindrical neck at its bottom, the cylindrical neck having a plurality of openings to allow combustion products to recirculate into the fuel container and an opening at the bottom end of the neck for admitting fresh air;

c) an outer cylindrical exhaust bin having a top wall and an opening at its bottom to allow the neck of the fuel container to pass therethrough, the said bottom opening is aligned with the bottom opening of the inner combustion bin;

d) a vertically placed air core combustion tube having a plurality of apertures along its length located in the inner combustion bin and at least partly located within the fuel container to allow air to pass from the neck of the fuel container to a combustion area;

wherein the inner combustion bin is spaced apart from the outer exhaust bin so that the combustion products existing the vent openings of the inner combustion bin can pass between the inner combustion bin and the outer exhaust bin and recirculate into the fuel container via the plurality of openings of the cylindrical neck.

* * * * *